United States Patent [19]

Key, Jr.

[11] 4,067,573

[45] Jan. 10, 1978

[54] PUTTER HAND GRIP

[76] Inventor: Jack B. Key, Jr., P.O. Box 5625, Columbus, Ga. 31906

[21] Appl. No.: 778,946

[22] Filed: Mar. 18, 1977

[51] Int. Cl.[2] ..... A63B 53/14

[52] U.S. Cl. ..... 273/81.4; 273/81 B

[58] Field of Search ..... 273/81 R, 81 A, 81 B, 273/81 D, 81.3–81.6, 165; D34/5 GS

[56] References Cited

U.S. PATENT DOCUMENTS

| | | | |
|---|---|---|---|
| D. 194,471 | 1/1963 | Dishner | D34/5 GS |
| 1,677,099 | 7/1928 | Harness | D34/5 GS |
| 2,131,966 | 10/1938 | Nelson | 273/81 R |
| 3,077,349 | 2/1963 | Leonard | 273/81.4 |
| 3,219,348 | 11/1965 | Dishner | 273/81 B X |
| 3,263,998 | 8/1966 | Fanning | 273/81.4 |
| 3,319,962 | 5/1967 | Summers | 273/81.4 X |
| 3,376,038 | 4/1968 | Henry | 273/81 R |
| 3,860,243 | 1/1975 | Prisco | 273/81 D X |

*Primary Examiner*—Richard J. Apley
*Attorney, Agent, or Firm*—D. Paul Weaver

[57] ABSTRACT

To promote control and accuracy during the putting stroke and to provide a more comfortable and efficient grip on the putter, a somewhat bulbous handle is provided on the club including substantially flat surfaces on the sides and top of the hand grip for the forefingers and the two thumbs. The under side of the hand grip is transversely arcuate to comfortably accommodate the remaining fingers in interlocked relationship. From the top of the club shaft rearwardly, the hand grip cross section is of modified rectangular form gradually becoming circular and gradually enlarging to a point near the longitudinal center of the grip.

10 Claims, 6 Drawing Figures

FIG.1
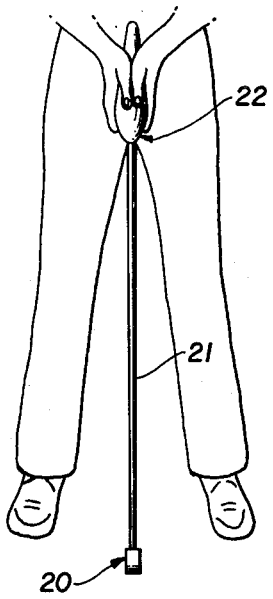
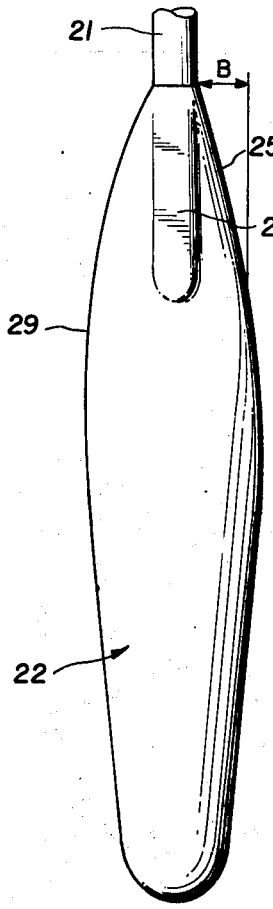
FIG.8
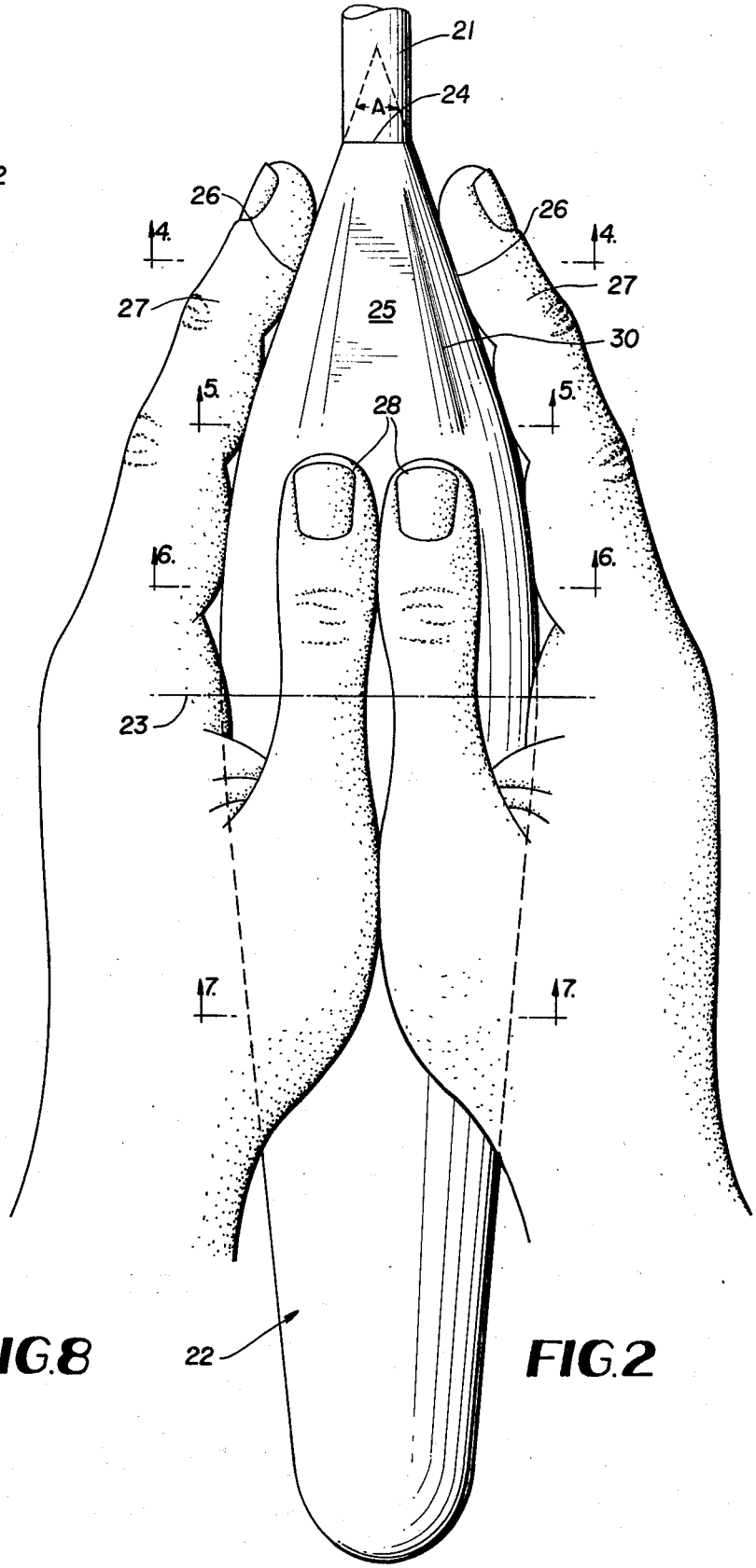
FIG.2

FIG. 3
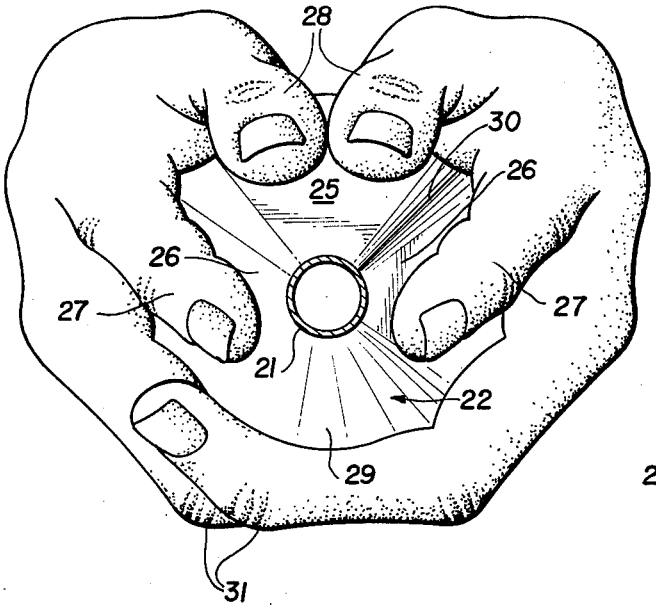
FIG. 4
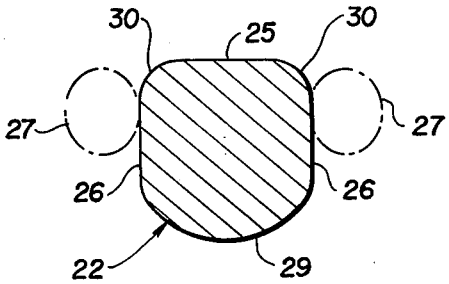
FIG. 5
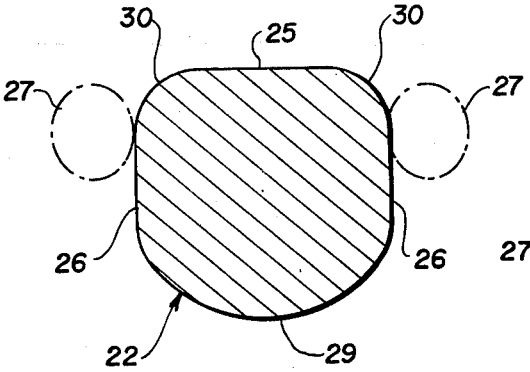
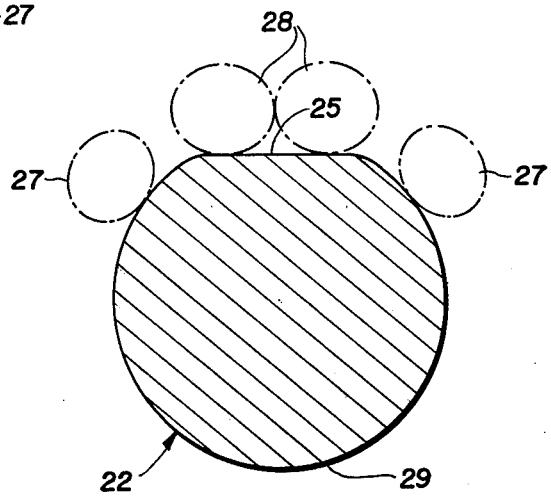
FIG. 6
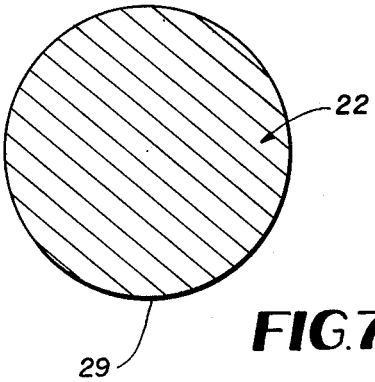
FIG. 7

PUTTER HAND GRIP

BACKGROUND OF THE INVENTION

Proposals have been made in the prior art to provide more functional and more comfortable hand grips on golf clubs particularly putters so that better control and accuracy of putting may be obtained. Such devices, to be successful, must conform to the "Rules of Golf" published by the U.S.G.A. They must also be practical in terms of cost, weight factors and reasonably acceptable appearance. Some examples of the known prior art are contained in prior U.S. Pat. Nos. 1,677,099; 3,219,348 and 3,263,998.

The objective of the present invention is to further improve on the prior art in terms of a hand grip for putters which is even more comfortable to use and will provide even greater accuracy and control while putting.

More particularly, the invention is embodied in an elongated slightly bulbous hand grip which tapers forwardly and rearwardly from a median point of substantially circular cross section. Forwardly of this median point, the hand grip has a gradually changing cross sectional shape which provides flat faces on the opposite sides of the grip for the index or forefingers and a common flat face on the top of the grip for the two thumbs. At all cross sectional points, the under side of the grip is transversely curved on a preferably circular arc. The two side flat faces are at right angles to the top flat surface which receives the thumbs. The side flat surfaces for the forefingers converge rather steeply into the club shaft and are symmetrical with the central axis of the shaft. The two side flat surfaces have an included angle in the range of 30° to 40°, preferably, and the top flat surface on which the thumbs rest are at a somewhat less steep angle to the club shaft axis, such as about 15° to 20°. The hand grip is of modified rectangular cross section from its juncture with the club shaft rearwardly and is gradually enlarged rearwardly to said median point. The cross sectional shape of the grip gradually changes to circular as the median point of the grip is approached rearwardly from the forward extremity of the grip.

Other features of the invention will become apparent during the course of the following detailed description.

BRIEF DESCRIPTION OF THE DRAWINGS

FIG. 1 is a perspective view of a putter having the hand grip in accordance with this invention.

FIG. 2 is an enlarged top plan view of the hand grip shown in association with the hands of a user of the putter.

FIG. 3 is a forward end elevation of the hand grip with the club shaft in cross section.

FIGS. 4, 5, 6 and 7 are a series of transverse cross sections through the hand grip taken on lines 4—4, 5—5, 6—6 and 7—7 of FIG. 2 to illustrate the varying cross sectional shape of the grip.

FIG. 8 is a side elevational view of the hand grip.

DETAILED DESCRIPTION

For purposes of the invention, the putter hand grip can be formed of any acceptable material, such as molded plastic or lightweight metal. The grip may be covered with any suitable anti-slip surfacing material, such as leather or the like, and may if desired by slightly corrugated transversely as by wrapping overlapping spiral convolutions of covering material around the grip. Such special surfacing features and materials are omitted in the drawings for simplicity of illustration and to better emphasize the invention which lies totally in the shape of the hand grip.

Referring to the drawings in detail, wherein like numerals designate like parts, a golf putter 20, as shown in FIG. 1, has a shaft 21 equipped with the improved hand grip 22 embodying the present invention. The hand grip 22 is elongated, measuring approximately ten inches, more or less, in overall length and being somewhat bulbous and having a maximum diameter or girth at its median point of about two to two and one-quarter inches. These overall dimensions are not critical and will vary somewhat in the manufacturing of the hand grip to fit various hand sizes. The shape of the hand grip 22, however, will be uniform from club-to-club and will not vary.

To increase putter control and putting accuracy as well as comfort and stability, the hand grip 22 tapers forwardly from a median point approximately at 23 where the grip is circular in cross section to its juncture at 24 with the club shaft 21. The hand grip also tapers gradually rearwardly from the median point 23 to its rearmost end and in all cross sectional planes behind the median point 23 the hand grip is circular in cross section as shown by FIG. 7.

Forwardly of the median point 23, the hand grip constantly changes and gradually diminishes in girth and also constantly changes in cross sectional form. Referring to FIG. 4 showing a cross sectional plane through the hand grip 22 somewhat rearwardly of the shaft juncture 24, the grip is of a modified rectangular cross section to provide a top flat face 25 to serve as a rest for the two thumbs and a pair of spaced parallel side flat faces 26 at right angles to the face 25 to serve as rests for the two forefingers 27. The cross sectional plane in FIG. 4 is ahead of the two thumbs 28 so that the latter do not appear in phantom lines along with the forefingers 27. As shown in all of the drawing figures, including FIG. 4, the under surface 29 of the hand grip 22 is transversely curved preferably on a circular arc concentric with the club shaft axis. Where the flat surfaces 25 and 26 are joined, sharp corners are eliminated by radii sections 30.

FIG. 5 shows another cross sectional plane through the hand grip somewhat rearwardly of the plane of FIG. 4 and it can be observed that the essentially flat surfaces 25 and 26 are still present and the cross sectional size of the grip has increased somewhat. FIG. 6 shows still another cross sectional plane through the hand grip further back and at this plane, the side flat surfaces 26 for the forefingers 27 have disappeared but the upper substantially flat surface 25 to form a rest for the two thumbs 28 is still present, as illustrated. Below the flat surface 25 at the plane of FIG. 6, the cross sectional shape of the grip is circular, and at all points behind the plane of FIG. 6, the shape is circular as previously stated, FIG. 7.

It should now be clear that between the juncture 24 and median point 23, the critical portion of the hand grip constantly and gradually changes in shape and in girth, tapering forwardly. It is of modified rectangular cross section gradually changing rearwardly into circular cross sectional shape and the lower side of the grip at all cross sectional planes is rounded. The two side flat faces 26 which rest the forefingers during usage begin at or near the shaft juncture 24 but terminate at their rear ends further forwardly than the upper thumb rest flat surface 25. That is to say, the thumb rest surface 25 extends further rearwardly on the hand grip, FIG. 2, as the two thumbs are naturally arranged rearwardly of the forefingers when gripping the club. The remaining fingers of the two hands shown at 31, FIG. 3, pass around the curved lower surface 29 of the hand grip and may be interlocked in any conventional way below the hand grip. The total configuration of the grip affords a most secure, stable and comfortable grip for the two hands and promotes maximum control and accuracy during putting, as explained.

The two side flat surfaces 26 define an included angle A of roughly 30° to 40° and not more than 45°, and the top flat surface 25 is inclined with respect to the longitudinal axis of the hand grip at an angle B of roughly 15° to 20°, preferably.

The advantages of the invention should now be quite clear in view of the foregoing description.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A putter hand grip comprising a hand grip body of sufficient length to be placed between the two hands of a user and tapering forwardly from a median point of maximum hand grip girth between the forward and rear ends of said hand grip body, the hand grip body provided on its tapering portion with an upper side flat surface forming a rest for the two thumbs of a user and a pair of opposite side flat surfaces forming rests for the index fingers of a user and being substantially at right angles to said top side flat surface, and the under side of said hand grip body being transversely rounded to provide a conforming rest surface for the other fingers of a user.

2. A putter hand grip as defined in claim 1, and said upper side flat surface extending a greater distance rearwardly on said hand grip body than said opposite side flat surfaces.

3. A putter hand grip as defined in claim 1, and said opposite side flat surfaces define an included angle of 30° to 40°.

4. A putter hand grip as defined in claim 1, and said upper side flat surface being inclined relative to the longitudinal axis of the hand grip in the range of 15° to 20°.

5. A putter hand grip as defined in claim 1, and the forwardly tapering portion of said hand grip body being of modified rectangular cross sectional form and gradually diminishing in girth forwardly and gradually becoming circular in cross sectional shape rearwardly toward said median point.

6. A putter hand grip as defined in claim 1, and said hand grip body being elongated and gradually tapering rearwardly from said median point and being substantially circular in cross section at all cross sectional planes rearwardly of said median point.

7. A putter hand grip as defined in claim 6, and said hand grip body being somewhat bulbous and gradually curved on its opposite sides and top and bottom surfaces adjacent said median point.

8. A putter hand grip as defined in claim 7, and said hand grip body having an overall length of roughly ten inches and a maximum girth at said median point of roughly two inches in diameter.

9. A putter hand grip as defined in claim 1, and said right angular upper side and opposite side flat surfaces being joined by smoothly rounded shoulder portions.

10. A putter hand grip as defined in claim 1, and said under side of the hand grip body being circularly curved transversely.

* * * * *